US006380490B1

(12) United States Patent
Gaston

(10) Patent No.: US 6,380,490 B1
(45) Date of Patent: Apr. 30, 2002

(54) ELECTRIC FENCE INSULATOR

(76) Inventor: Charles O. Gaston, 5355 E. County Rd. 1000 South, Cloverdale, IN (US) 46120

( * ) Notice: Subject to any disclaimer, the term of this patent is extended or adjusted under 35 U.S.C. 154(b) by 0 days.

(21) Appl. No.: 09/595,245

(22) Filed: Jun. 16, 2000

(51) Int. Cl.[7] ..... H01B 17/14

(52) U.S. Cl. ..... 174/158 F; 174/161 F; D13/132; D26/1 R; D26/10; 256/10; 256/DIG. 3; 248/71

(58) Field of Search ..... 174/158 F, 161 F, 174/163 F, 161 R, 40 CC, 40 TD, 45 R, 70 A, 72 A; D13/132; D26/1 R, 10; 256/10, DIG. 3, DIG. 5; 248/71, 72

(56) References Cited

U.S. PATENT DOCUMENTS

D213,106 S * 1/1969 Baatz ..... D13/132
3,749,820 A * 7/1973 Langlie et al. ..... 174/163 F
D233,311 S * 10/1974 Wilson ..... D13/132
D243,343 S 2/1977 Berg, Jr. et al.
4,845,317 A * 7/1989 Wilson ..... 174/163 F
D331,221 S 11/1992 Langlie et al.
D347,823 S 6/1994 Berg et al.
5,920,036 A 7/1999 Egger
5,959,255 A 9/1999 Langlie et al.
6,198,048 B1 * 3/2001 Juhel et al. ..... 174/70 A

* cited by examiner

*Primary Examiner*—Anthony Dinkins
*Assistant Examiner*—Adolfo Nino
(74) *Attorney, Agent, or Firm*—Woodard, Emhardt, Naughton Moriarty & McNett

(57) ABSTRACT

An insulator for mounting an electric wire to a round vertical post. The insulator main body includes an outwardly opening slot through which the round post may be moved as the insulator is removed from the post. A nut is threadedly mounted at the slotted end of the main body limiting movement of the round post within the slot. A spacer within the slot limits inward movement of the slot walls. Various embodiments of the spacer are disclosed.

20 Claims, 4 Drawing Sheets

ELECTRIC FENCE INSULATOR

BACKGROUND OF THE INVENTION

The present invention relates generally to the field of insulators for holding electric wires.

DESCRIPTION OF THE PRIOR ART

Electric fences are used to limit movement of livestock. The typical electric fence includes a plurality of upright vertically extending posts located along the length of the fence. The posts have round or circular cross-sections. An upper and lower electric wire extend horizontally the length of the fence and are mounted to the round posts by plastic electric insulators. Once such insulator is shown in U.S. Design Pat. No. 243,343. Variations of the insulators are shown in U.S. Design Pat. Nos. 331,221 and 347,823.

Referring to U.S. Design Pat. No. 347,823, a nut is threadedly and movably mounted to one end of the insulator which has a vertical slot extending therethrough to receive the round post. In the event the insulator holding the bottom wire is damaged, then the top wire and associated insulator must first be removed in order to slide the bottom insulator upward passed the top end of the post. A fence extending a long distance has a number of insulators and thus to repair the bottom insulators becomes a time consuming chore. I have therefore designed a new insulator that may be removed from the round post without the necessity of removing the upper insulators. My new insulator includes a slotted open end closed by the nut with the nut being removable and the insulator moved horizontally apart from the post.

Additional insulators include the insulator shown in U.S. Pat. No. 5,959,255 for mounting an electric wire to a chain link fence and the insulator disclosed in U.S. Pat. No. 5,920,036 for mounting an electric wire to a rectangular fence post.

SUMMARY OF THE INVENTION

One embodiment of the present invention is an electric insulator for mounting an electric wire to a round fence post comprising a main body with a first end to mountingly and removably receive an electric wire and an opposite second end to removably mount to a round fence post. The main body includes a round post receiving slot with a closed end and an open end. The closed end of the slot is located closer to the first end of the insulator than the open end of the slot through which the post is removable. An internally threaded nut is threadedly mounted to the insulator main body and extends across the slot between the closed end and the open end limiting removal through the open end.

One embodiment of the present invention is to provide a new and improved electric fence insulator for a round post.

A further object of the present invention is to provide a round post insulator removable from the post without the necessity of removal of additional insulators.

Related objects and advantages of the present invention will be apparent from the following description.

DESCRIPTION OF THE PREFERRED EMBODIMENTS

Figure 1:
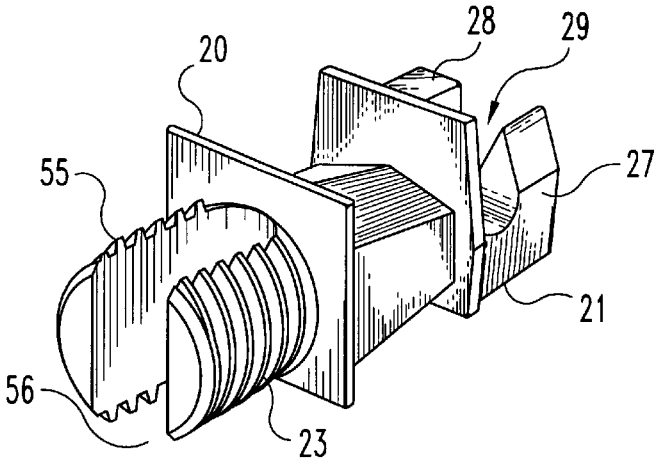
FIG. 1 is a perspective view of the insulator incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 5:
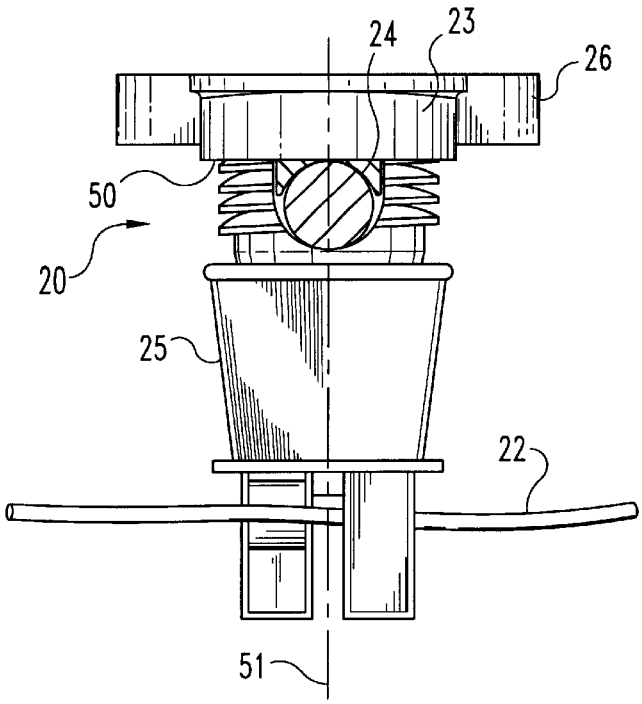
FIG. 5 is the same view as FIG. 3 only with the nut mounted to the insulator main body, in turn, mounted to a round post and holding an electric wire.

Referring now more particularly to FIGS. 1 and 5, there is shown an electric insulator 20 having a first end 21 removably holding a horizontally extending electric wire 22 and an opposite second end 23 removably mounted to a vertically extending round fence post 24. Insulator 20 has a main body 25 threadedly receiving a removable nut 26 both of which are produced from an insulating material such as plastic.

Figure 2:
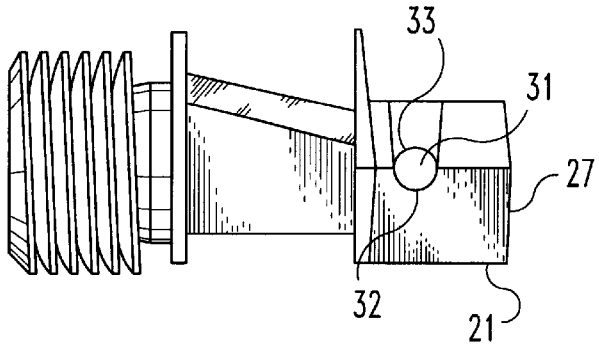
FIG. 2 is a side view.
Figure 4:
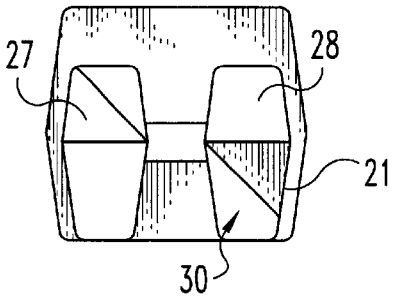
FIG. 4 is an end view.

The main body 25 of insulator 20 includes the first end 21 forming the distal end of the insulator. End 21 includes a pair of oppositely directed arms 27 and 28 (FIG. 4) integrally attached thereto. Arm 27 (FIG. 1) extends upwardly forming an upwardly opening recess 29. Likewise, arm 28 extends downwardly forming a downwardly opening recess 30. A circular passage 31 (FIG. 2) is formed between a upwardly curved surface 32 of arm 27 and a downwardly curved surface 33 of arm 28 with the arms being spaced apart on the opposite sides but at the same end of the insulator main body. Thus, the electric wire 22 may be slipped into recess 29 and then bent downwardly around the bottom end of arm 28 fitting into recess 30 with the wire 22 then occupying the circular passage 31. These pair of arms are included in the prior art insulators and are commercially available to removably mount an electric wire 22 thereto.

Figure 3:
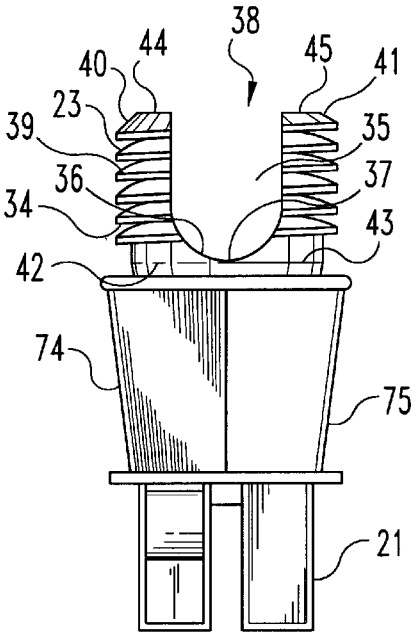
FIG. 3 is a top view.

The opposite end 23 of the insulator main body has a cylindrical configuration with an external thread 34 (FIG. 3) extending therearound. A slot 35 has a first end 36 forming a curved surface 37 facing outwardly through the open end 38 of the slot. Slot 35 extends entirely through the main body of the insulator at end 23 thereby dividing the cylindrical wall 39 of end 23 into a pair of members 40 and 41 having proximal ends 42 and 43 cantileverdly mounted to the insulator main body and opposite spaced apart distal ends 44 and 45 through and between which round post 24 may move.

An internally threaded nut 26 (FIG. 5) is removably and threadedly mounted to end 23 forming the proximal end of the insulator secured to the round fence post. Nut 26 has an inwardly facing contact surface 50 opposed from the outwardly facing curved surface 37 formed at the end of slot 35. As nut 26 is rotated, the distance between the surfaces 50 and 37 is changed. In order to mount the insulator to round fence post 24, nut 26 may be tightened so that surface 50 contacts the outer cylindrical surface of post 24 which is forced toward curved surface 37 thereby securing the insulator to the post. Surface 50 extends across slot 35 closing the open end of the slot thereby holding the post within the slot and limiting movement therefrom. In order to remove the insulator from the post, nut 26 is rotated about its longitudinal axis 51 until the nut is removed entirely from the insulator main body thereby opening slot 35 and allowing post 24 to move between distal ends 44 and 45 with the post then being moved entirely from the slot and the insulator.

Surface 37 is spaced apart an insulating distance from end 21 thereby insulating the electric wire from the vertically extending round post. Surface 37 and surface 50 form a round post holding space which may be varied in size depending upon the size of the post. Surface 50 extends across the top 55 (FIG. 1) of the slot and the bottom 56 of the slot between surface 37 and the outer ends 44 and 45 thereby closing the slot and limiting removal of the post from the slot between the outer ends. Closed end 36 of slot 35 is located closer to distal end 21 than the open end 38 of the slot. The nut is removable from the proximal end of the insulator main body in order to allow for the removal of the round post from the slot between the distal ends.

Figure 7:
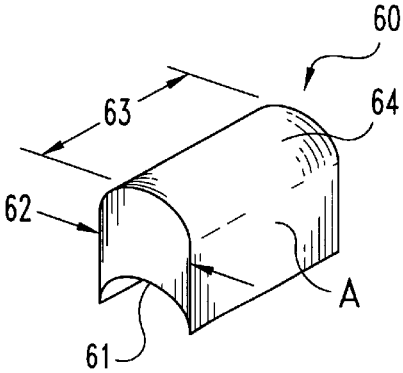
FIG. 7 is a perspective view of version A of the insulator spacer.

A spacer 60 (FIG. 7) is located within slot 35 between members 40 and 41 to prevent the members from moving inwardly as the nut is tightened. Spacer 60 has an inwardly facing curved surface 61 to extend partially around round post 24 and has a width 62 and length 63 sized to provide a snug fit within slot 35.

Figure 12:
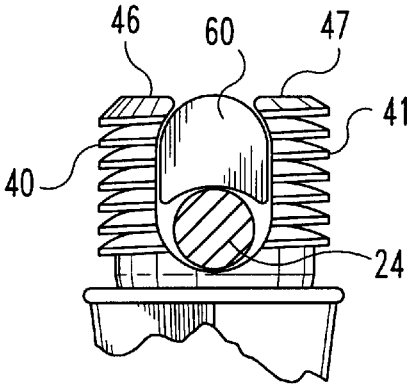
FIG. 12 is a fragmentary cross-sectional view of the proximal end of the insulator main body with the spacer of FIG. 7 located within the slot.

Alternative designs are provided and will be described for limiting movement of spacer 60 relative to the nut. In the embodiment of FIG. 12, the distal ends 46 and 47 of members 40 and 41 extend partially across the open end of the slot thereby preventing movement of spacer 60 between ends 46 and 47. Ends 46 and 47 are however spaced apart a sufficient distance to allow movement of the round fence post 24 therebetween once spacer 60 is slipped sideways out of the slot in a direction parallel to the longitudinal axis of the round fence post. With nut 26 mounted to the insulator main body, spacer 60 is prevented from moving in a direction parallel to the longitudinal axis of post 24, since the nut extends around the spacer. Likewise, the inwardly turned distal ends 46 and 47 prevent the spacer from moving outwardly along the longitudinal axis 51 of the insulator main body.

Figure 9:
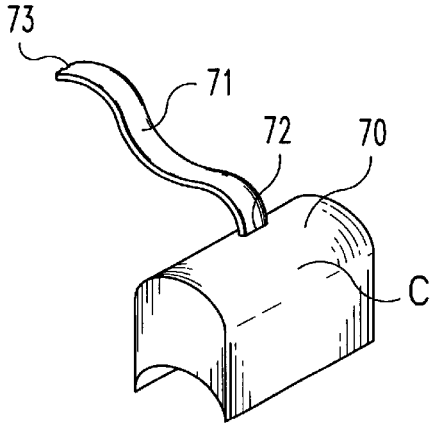
FIG. 9 is a perspective view of a second alternate embodiment or version C of the spacer of FIG. 7.

An alternate embodiment of the spacer is shown in FIG. 9. Spacer 70 is identical to spacer 60 except that a strap 71 has one end 72 fixedly attached to the spacer and an opposite end 73 connected to the insulator main body. End 73 may be connected to the spaced apart walls 74 and 75 spacing distal end 21 (FIG. 3) apart from proximal end 23. End 73 may be connected to a flat strip wedged between spaced apart walls 74 and 75 or may be integrally connected to either wall. Strap 71 allows for the removal of the spacer from slot 35 when nut 26 is removed without the spacer falling to the ground since the spacer is retained with the insulator main body by the strap.

Figure 6:
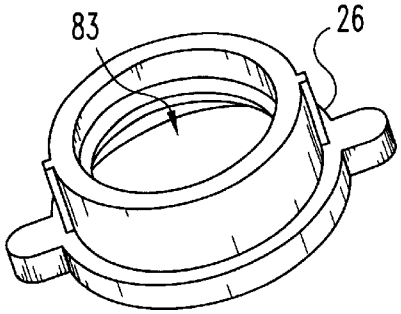
FIG. 6 is a perspective view of the nut mounted to the insulator main body of FIG. 5.
Figure 8:
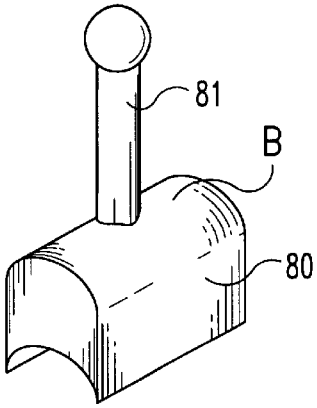
FIG. 8 is a perspective view of a first alternate embodiment or version B of the spacer of FIG. 7.
Figure 10:
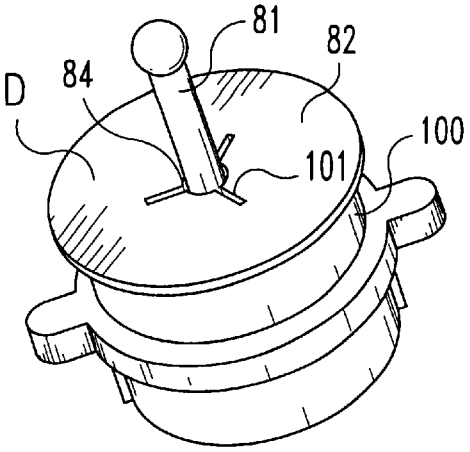
FIG. 10 is a perspective view of a first alternate embodiment or version D of the nut of FIG. 6 having the spacer of FIG. 8 mounted thereto.

A further embodiment of spacer 60 is depicted in FIG. 8. Spacer 80 is identical to spacer 60 with the exception that a pin 81 is fixedly connected thereto. Pin 81 extends outwardly between outer ends 44 and 45 (FIG. 3) or ends 46 and 47 (FIG. 12) with pin 81 further extending outwardly through hole 83 (FIG. 6) of nut 26 allowing the user to grasp the pin thereby holding spacer 80 as the cap is removed preventing the spacer from falling downwardly and becoming misplaced. Alternatively, a longer nut 82 (FIG. 10) with an extension 100 on the end opposite of the end having the internal threads is provided with a cap closing central passage 83 (FIG. 6). A central hole 84 (FIG. 10) is provided in the cap through which pin 81 extends. The cap of FIG. 10 includes the internal threads and is threadedly mounted to the proximal end of the insulator main body. The main body of nut has an extension 100 immediately beneath the cap so that the cap will not prevent tightening of the nut to the insulator main body. As the nut is rotated to remove the nut from the insulator of the main body, pin 81 may be held stationery since hole 84 is sized larger than the outside diameter of the pin. The cap has slots 101 extending therethrough allowing the end wall of the cap to flex to allow the ball shaped end of pin 81 to be forceably removed from the nut. As the nut is removed from the insulator body, pin 81 may be grasped thereby allowing for the simultaneous removal of the pin 81 and attached spacer 80 along with the nut. In the embodiment of FIG. 10, the outer ends 44 and 45 must not turn inwardly but must remain straight in order for the spacer to be pulled outwardly between outer ends 44 and 45.

Figure 11:
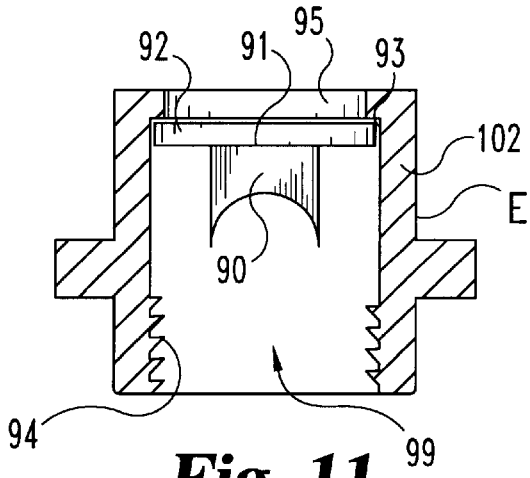
FIG. 11 is a cross-sectional view of a second alternate embodiment or version E of the nut of FIG. 6 with a captive spacer.

Yet a further embodiment of a spacer is depicted in cross-section in FIG. 11. Spacer 90 is identical to spacer 60 with the exception that the outwardly facing surface 91 is flat as compared to the curved outwardly facing surface 64 of spacer 60. Nut 102 is longer than nut 26 providing a recess 93. Spacer 90 is fixedly mounted to a disk 92 held captive within nut 102. Alternatively, spacer 90 and disk 92 are one piece. Nut 102 includes an internal recess 93 sized to receive disk 92. Nut 102 includes the internal threads 94 to threadedly mount to the proximal end of the insulator main body. Recess 93 is sized sufficiently to allow rotation of the nut 102 while spacer 90 is located within slot 35 with relative rotational motion occurring between the nut and disk 92. Spacer 90 can be used only with outer ends 44 and 45 which do not extend inwardly. Spacer 90 and disk 92 are forced into recess 93 through hole 95.

Figure 13:
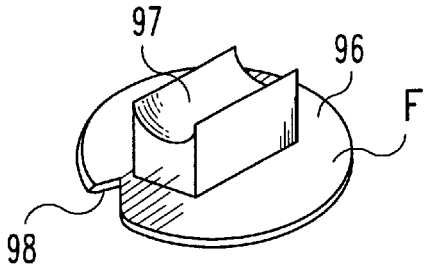
FIG. 13 is a perspective view of an alternate embodiment or version F of the spacer and attached disk.

An alternate embodiment of the spacer and disk of FIG. 11 is shown in FIG. 13. Disk 96 and spacer 97 are identical to disk 92 and spacer 90 with the exception that a notch 98 extends through disk 96 at the edge thereof. Thus, disk 96 and plug 97 may be mounted to nut 102 (FIG. 11) by threading the disk through hole 99 allowing threads 94 to pass through notch 98 with the disk then being rotated relative to the nut until the disk is held captive within recess 93.

Figure 14:
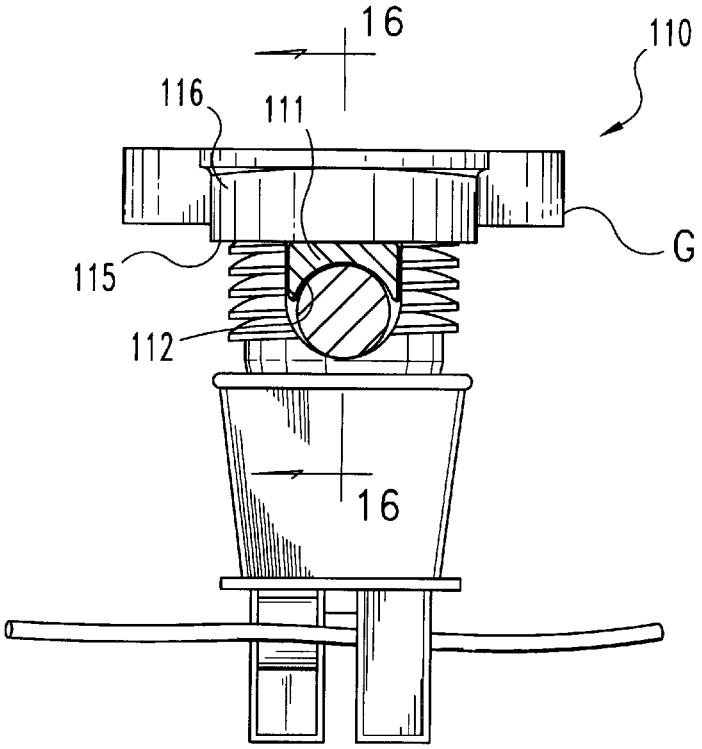
FIG. 14 is a side view of yet a further alternate embodiment or version G of the insulator.
Figure 15:
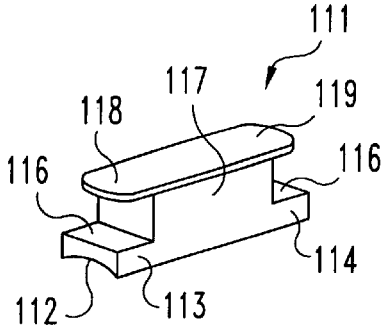
FIG. 15 a perspective view of the spacer used with the insulator of FIG. 14.
Figure 16:
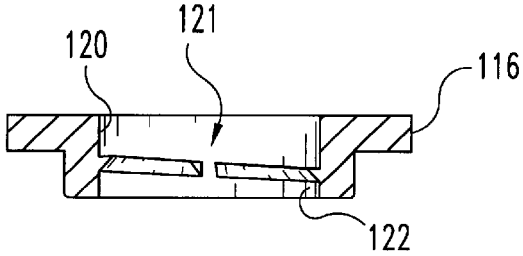
FIG. 16 is a cross sectional view of the cap taken along the line 16—16 of FIG. 14 viewed in the direction of the arrows.

Yet a further embodiment is shown in FIG. 14. Insulator 110 includes a insulator main body identical to main body 25(FIG. 5). The spacer 111(FIG. 15) mounted in the insulator 110 includes a curved surface 112 identical to curved surface 61(FIG. 7) but has ears 113 and 114 extending laterally outwardly from the main body of the spacer. Surface 112 is provided on the ears thereby providing more contact between the spacer and fence post. Further, the surface 115 of nut 116 facing the fence post contacts the outwardly facing surface 116 of ears 113 and 114 forcing surface 112 against the post. The opposite end 117 of the spacer may be provided with a pin 81(FIG. 8) extending outwardly to be used with the nut of FIG. 10 or may have outwardly extending ears 118 and 119 located inwardly of ears 113 and 114 and being received in recess 120 of the nut thereby holding the spacer captive relative to the nut. Recess 120 is provided with a slot 121 to allow the ears 118 or 119 to be threaded therethrough in order to position ears 118 and 119 in recess 120. In order to mount spacer 111 to nut 116, ears 118 and 119 are positioned in recess 122 with the nut then being rotated so ears 118 and 119 pass via slot 121 into recess 120 thereby leaving ears 113 and 114 to extend outwardly of the cap while contacting surface 115. Ears 118 and 119 are shorter than ears 113 and 114.

While the invention has been illustrated and described in detail in the drawings and foregoing description, the same is to be considered as illustrative and not restrictive in character, it being understood that only the preferred embodiments have been shown and described and that all changes and modifications the come within the spirit of the invention are desired to be protected.

What is claimed is:

1. The combination of:

a vertically extending round post;

a horizontally extending electric wire spaced apart from said post;

an electric fence insulator removably mounted to said vertically extending round post and holding said electric wire apart from said round post, said insulator including a main body having a distal end with an arm defining a recess holding said electric wire, said main body further including a proximal end with a plurality of outwardly extending members cantileverdly mounted thereto with said members having externally threaded outer surfaces, said members spaced apart and having permanently and fixedly spaced apart outer ends forming a vertically extending slot which opens outwardly through said outer ends and through which the round post is movable, said main body including a first holding surface facing toward said outer ends with said first holding surface spaced apart an insulating distance from said distal end; and, an internally threaded nut mounted to said proximal end and in meshing engagement with said externally threaded outer surfaces, said nut including a second holding surface facing and movable toward said first holding surface as said nut is rotated on said outer surface forming a round post holding space between said first holding surface and said second holding surface with said round post being held by said first holding surface and said second holding surface in said space, said second holding surface extending across said slot between said first holding surface and said outer ends closing said slot and limiting removal of said post from said slot between said outer ends, said nut being removable from said proximal end for said round post to be removed from said slot between said distal ends.

2. The combination of claim 1 and further comprising:

a spacer removably positioned between said members limiting inward movement of said members as said nut is tightened on said members.

3. The combination of claim 2 wherein:

said main body includes a pair of oppositely directed arms defining oppositely opening recesses holding said electric wire; and, said slot includes a closed end curved surface which forms said first holding surface.

4. The combination of claim 2 wherein:

said outer ends extend toward each other to limit movement of said spacer therebetween.

5. The combination of claim 2 and further comprising:

a strap having an end portion attached to said main body and an opposite end portion attached to said spacer limiting movement of said spacer from said main body.

6. The combination of claim 2 and further comprising:

a cap on said nut and connected to said spacer to hold said spacer to said nut.

7. The combination of claim 6 wherein:

said cap is positioned within said nut and is fixedly attached to said spacer.

8. The combination of claim 2 and further comprising:

an arm attached to said spacer and projecting outwardly of said main body at said proximal end to allow said spacer to be held as said nut is removed.

9. The combination of claim 8 and further comprising:

a cap on said nut and connected to said spacer to hold said spacer to said nut; and wherein said arm projects through said cap but is held captive thereto.

10. An electric insulator removably mountable to a vertically extending post and for holding thereto but spaced therefrom an electric wire comprising:

an electrically insulating main body having a first end portion with a recess for holding an electric wire, said main body further including a second end portion opposite of said first end portion with a plurality of outwardly extending members cantileverdly mounted thereto with said members having externally threaded outer surfaces, said members spaced apart and having spaced apart outer ends forming a vertically extending slot which opens outwardly through said outer ends and through which the post is movable, said main body including a first holding surface facing toward said outer ends with said first holding surface spaced apart an insulating distance from said first end portion; and, an internally threaded nut mounted to said second end portion and in meshing engagement with said externally threaded outer surfaces, said nut including a second holding surface facing and movable toward said first holding surface as said nut is rotated on said outer surface forming a post holding space between said first holding surface and said second holding surface, said second holding surface extending across said slot between said first holding surface and said outer ends, said nut being removable from said second end portion.

11. The insulator of claim 10 and further comprising:

a spacer removably positioned between said members limiting inward movement of said members as said nut is tightened on said members.

12. The insulator of claim 11 wherein:

said outer ends extend toward each other to limit movement of said spacer therebetween.

13. The insulator of claim 11 and further comprising:

a strap having an end portion attached to said main body and an opposite end portion attached to said spacer limiting movement of said spacer from said main body.

14. The insulator of claim 11 and further comprising:

a cap on said nut and connected to said spacer to hold said spacer to said nut.

15. The insulator of claim 14 wherein:

said cap is positioned within said nut and is fixedly attached to said spacer.

16. The insulator of claim 11 and further comprising:

an arm attached to said spacer and projecting outwardly of said main body at said proximal end to allow said spacer to be held as said nut is removed.

17. The insulator of claim 16 and further comprising:

a cap on said nut and connected to said spacer to hold said spacer to said nut; and wherein said arm projects through said cap but is held captive thereto.

18. An electric insulator for mounting an electric wire to a round fence post comprising:

a main body with a first end to mountingly and removably receive an electric wire and an opposite second end to removably mount to a round fence post, said main body including a round post receiving slot with a closed end and an open end, said closed end located closer to said first end than said open end through which said post is removable; and, an internally threaded nut threadedly mounted to said second end and extending across said slot between said closed end and said open end limiting removal through said open end.

19. The insulator of claim 18 wherein said second end includes a wall through which said slot extends and has external threads in meshing engagement with said nut and further comprising:

a spacer located in said slot limiting inward movement of said wall as said nut is tightened thereon.

20. The insulator of claim 19 wherein said spacer includes a pair of ears extending laterally outwardly therefrom forming a curved surface to contact a fence post.

* * * * *